US005483728A

United States Patent [19]

Dingle, Sr.

[11] Patent Number: 5,483,728

[45] Date of Patent: Jan. 16, 1996

[54] REMOVABLE SUSPENDERS HOLDER

[76] Inventor: Joseph Dingle, Sr., 623 Todd Cir., Warner Robins, Ga. 31088

[21] Appl. No.: 223,013

[22] Filed: Apr. 5, 1994

[51] Int. Cl.[6] ..... A44B 9/00

[52] U.S. Cl. ..... 24/707.6; 24/706.3; 24/136 R

[58] Field of Search ..... 24/707.6, 706.3, 24/708.3, 518, 186, 168, 307

[56] References Cited

U.S. PATENT DOCUMENTS

| | | | |
|---|---|---|---|
| 438,693 | 10/1890 | Lieberthal | 24/186 |
| 890,999 | 6/1908 | Newman | 4/615 |
| 943,976 | 12/1909 | Kornreich | 24/129 R |
| 1,071,688 | 9/1913 | Bond | 24/706.3 |
| 1,083,425 | 1/1914 | Bagley | 24/707.6 |
| 1,100,308 | 6/1914 | Jones | 24/136 R |
| 1,931,671 | 10/1933 | Miserentino | 24/707.6 |
| 3,311,958 | 4/1967 | Reeves | 24/707.6 |
| 3,825,955 | 7/1974 | Penzel | 24/707.6 |
| 3,893,819 | 7/1975 | Schaiewitz | 24/706.3 |

FOREIGN PATENT DOCUMENTS

| | | | |
|---|---|---|---|
| 0044259 | 10/1910 | Australia | 24/168 |

*Primary Examiner*—Victor N. Sakran

[57] ABSTRACT

An removable suspenders holder including a pin member having a knobbed first end and a threaded second end which is additionally pointed thereby being penetrably insertable through various fabrics employed in garments. The pin member is woven through a suspender end portion and the waistband of the garment. A cap member is threadedly affixed to the second end of the pin member thereby affixing the suspender to the garment.

6 Claims, 4 Drawing Sheets

PRIOR ART

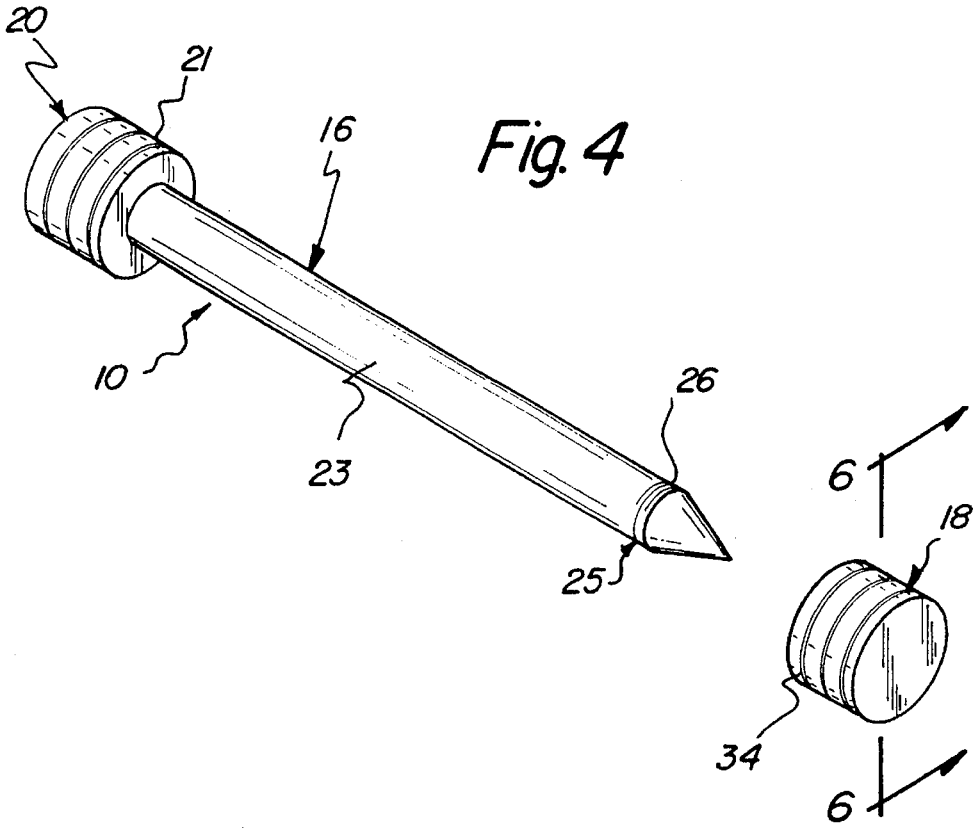
Fig. 4
Fig. 5
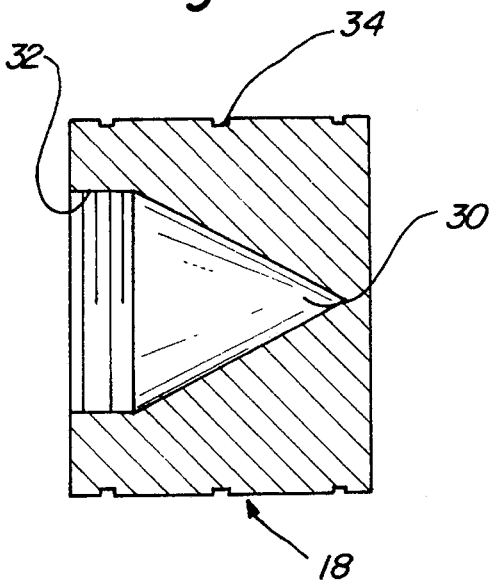

REMOVABLE SUSPENDERS HOLDER

BACKGROUND OF THE INVENTION

1. Field of the Invention

The present invention relates to suspenders holders and more particularly pertains to a removable suspenders holder which may be employed to detachably secure suspenders to garments.

2. Description of the Prior Art

The use of suspenders holders is known in the prior art. More specifically, suspender holders heretofore devised and utilized for detachably affixing suspenders to garments are known to consist basically of familiar, expected and obvious structural configurations, notwithstanding the myriad of designs encompassed by the crowded prior art which have been developed for the fulfillment of countless objectives and requirements.

The present invention is directed to improving devices for a removable suspenders holder in a manner which is safe, secure, economical and aesthetically pleasing.

For example, U.S. Pat. No. 4,489,466 to Bakker discloses a series of levers, a ratchet, and pivotal jaws which releasably affix suspenders to a garment. The present invention has no requirement for grasping a garment by jawlike members and provides a more positive attachment by threadedly engaging the garment.

In U.S. Pat. No. 4,901,408 to Hermann a means for fastening suspenders to a garment or other article of clothing is disclosed. The Hermann invention comprises a hingedly pivoting post member and a receiving member substantially permanently affixed to a suspender wherein the post member fully penetrates a garment and engages the receiving member on an opposite garment side thereby providing attachment. The present invention is not affixed to a suspender except when in use and has no pivotally attached post and receiving members, rather a pin member engages a cap member wherein the pin member is threaded through the inner waistband of a garment and generally does not penetrate an outer layer of the garment.

In U.S. Pat. No. 3,422,504 to Brown a suspender clip is described. The Brown invention comprises a substantially thin clip member having a flat base part with an aperture and a flat tab portion disposed within the aperture. The edges of the aperture and tab of the Brown invention are serrated and a head portion of the tab is larger than the aperture. Serrations in the Brown invention engage a garment thereby affixing a suspender thereon. The Brown invention is directed toward use with ladies stockings and similar thin meshlike materials. The present invention employs no serrations and provided for complete penetration of a portion of a garment to achieve attachment of suspenders thereon. The present invention is designed for suspension of heavier articles of clothing and is not therefore limited to the thin, lightweight materials used in ladies stockings.

In U.S. Pat. No. 3,660,874 to Platt a pin fastener is disclosed for removably holding an ornamental object to a garment. The Platt invention comprises a ring member to which a pin member is slidably and pivotally attached. A disadvantage in this prior art lies in a lack of provision for attachment to a portion of a suspender and a lack of design provision for holding a heavy garment to a suspender. The present invention affixes a suspender portion to a garment in a manner which provides secure attachment of the heaviest garment and maintains this attachment during all forms of movement and activity undertaken by the user.

U.S. Pat. No. 3,597,812 to Allan discloses a suspender clip. The disclosure teaches a suspender clip for women's stockings formed from a strip of plastic material wherein a tonguelike portion of the strip is threaded into a keyhole shaped slot in a flattened portion of the strip while the material of the stocking is disposed therebetween. The disclosure makes no provision for holding heavier garments such as trouserlike clothing articles. Furthermore, there are no provisions for penetrably affixing a portion of the clip to the garment. The present invention comprises a pin member which is threadedly attached to a suspender portion and an inside waistband of a garment and is furthermore not designed for use in suspending ladies stockings.

In this respect, the removable suspenders holder according to the present invention substantially departs from the conventional concepts and designs of the prior art, and in so doing provides an apparatus primarily developed for the purpose of releasably attaching suspenders to a garment.

Therefore, it can be appreciated that there exists a continuing need for new and improved removable suspenders holder which can be easily attached and by an individual requiring minimal skill and expenditure of effort. In this regard, the present invention substantially fulfills this need.

As illustrated by the background art, efforts are continuously being made in an attempt to improve suspender attachment devices. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of suspender attachment devices now present in the prior art, the present invention provides an improved removable suspenders holder construction wherein the same can be utilized for detachably securing suspenders to garments such as trouserlike clothing articles. As such, the general purpose of the present invention, which will be described subsequently in greater detail, is to provide a new and improved removable suspenders holder apparatus and method which has all the advantages of the prior art suspender attachment devices and none of the disadvantages.

The invention is defined by the appended claims with the specific embodiment shown in the attached drawings. For the purpose of summarizing the invention, the invention may be incorporated into a pin member and a cap member wherein the pin member comprises a knobbed first end portion, a cylindrical center portion and a pointed second end portion having threads disposed thereon, and the cap member comprises an enlarged knoblike part threadedly engaging the pointed second end portion. In operation the pointed second end portion is threaded firstly through the suspender, secondly through the inside waistband of the garment, and thirdly through the suspender wherein the cap member is installed and the attachment is complete.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved removable suspenders holder capable of being employed with a wide range of existing suspender types.

It is therefore an additional object of the present invention to provide a new and improved removable suspenders holder which has all the advantages of the prior art removable suspenders holders and none of the disadvantages.

It is another object of the present invention to provide a new and improved removable suspenders holder which may be easily and efficiently manufactured and marketed.

It is a further object of the present invention to provide a new and improved removable suspenders holder which is of a durable and reliable construction.

An even further object of the present invention is to provide a new and improved removable suspenders holder which is susceptible of a low cost of manufacture with regard to both materials and labor, and which accordingly is then susceptible of low prices of sale to the consuming public, thereby making such removable suspenders holders economically available to the buying public.

Still yet another object of the present invention is to provide a new and improved removable suspenders holder which provides in the apparatuses and methods of the prior art some of the advantages thereof, while simultaneously overcoming some of the disadvantages normally associated therewith.

Still another object of the present invention is to provide a new and improved removable suspenders holder which is applicable to various trouser, short, and skirt garments not requiring the use of additional attachment means such as buttons or clips.

Yet another object of the present invention is to provide a new and improved removable suspenders holder which may be worn during various activities without inadvertent detachment.

Even still another object of the present invention is to provide a new and improved removable suspenders holder which is non corroding and will not rust or otherwise stain clothing to which it is attached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a fragmentary exploded perspective view of a removable suspenders holder showing a pin member and cap member.

FIG. 5 is a side sectional view of the removable suspenders holder taken substantially upon the plane indicated by the section line 5—5 of FIG. 4.

DESCRIPTION OF THE PREFERRED EMBODIMENT

Figure 1:
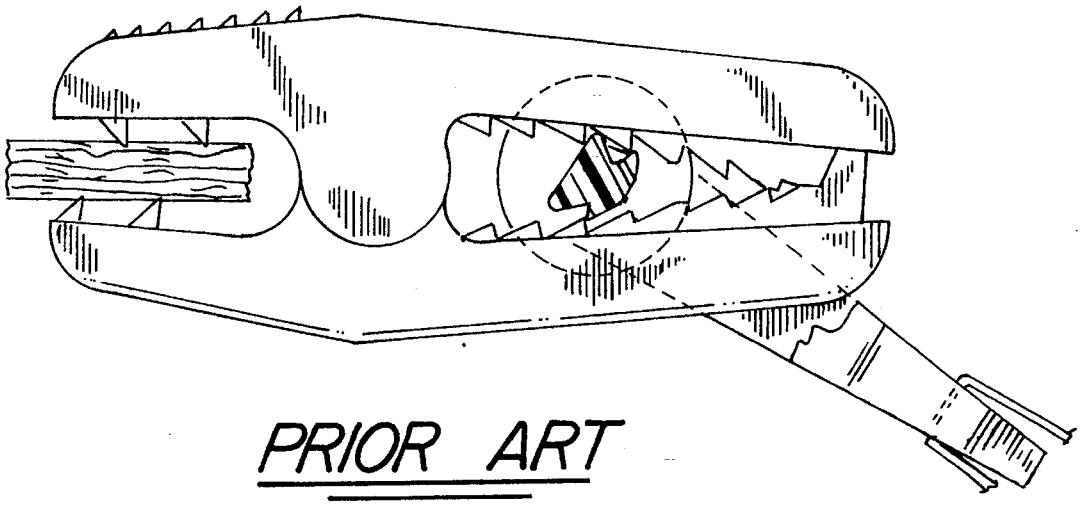
FIG. 1 is a side elevational view of prior art.
Figure 2:
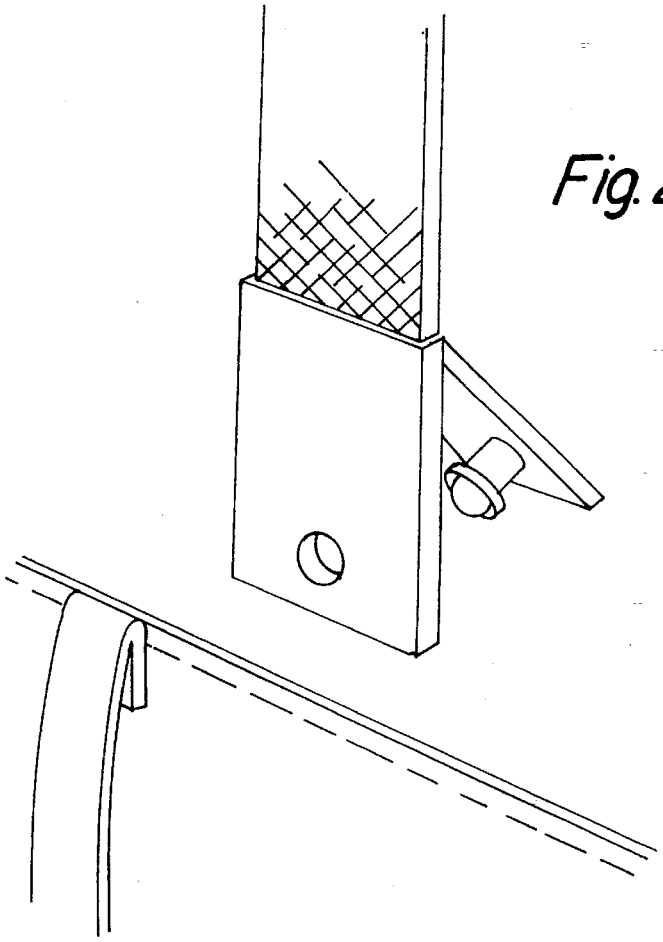
PRIOR ART Fig. 2
FIG. 2 is a fragmentary perspective view of prior art.
Figure 3:
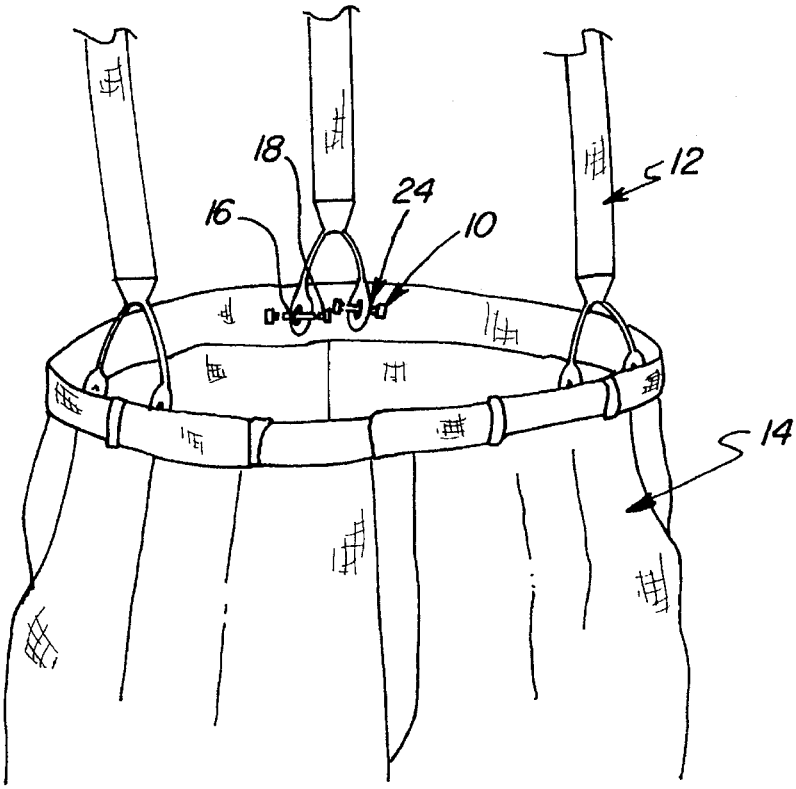
FIG. 3 is fragmentary perspective view of the removable suspenders holder showing the attachment to the inside waistband of a trouserlike clothing article.

With reference now to the drawings, and in particular to FIG. 1 thereof, a new and improved removable suspenders holder embodying the principles and concepts of the present invention and generally designated by the reference numeral 10 will be described. From an overview standpoint, the removable suspenders holder 10 is adapted for use with existing suspenders 12 and garments 14 for the purpose of establishing a releasable interconnection thereupon. See FIG. 3. The removable suspenders holder 10 comprises an elongated pin member 16 and a cap member 18. The pin member 16 is threadedly affixed to a first location of garment 14, a suspender attachment ear 24, and a second location of the garment 14. The cap member 18 is threadedly or otherwise attached to the pin member 16 thereby securing the suspender 12 to the garment 14.

More specifically, it will be noted that the removable suspenders holder 10 comprises an elongated substantially cylindrical pin member 16 and an engaging cap member 18. See FIG. 4. Cylindrical pin member 16 comprises a knobbed first end portion 20, a substantially cylindrical central portion 23, and a pointed second end portion 25. The composition of cylindrical pin member 16 may be brass, plated steel or brass, stainless steel, gold or silver precious alloy, plastic or composite, or any other rigid, durable material which is unlikely to corrode or stain a garment or human skin disposed in contact therein. Knobbed first end portion 20 comprises a short substantially cylindrical solid having a series of grooves 21 disposed thereon. Grooves 21 frictionally engage human fingers and may alternately comprise one or more knurled zones.

Substantially cylindrical central portion 23 may be of solid or tubular construction and, although a right cylindrical shape is suitable, may deviate substantially from a cylinder to include rods of substantially rectangular cross section. Pointed second end portion 25 is pointedly tapered to enable manual penetration of heavy, closely woven fabric layers. Pointed second end portion 25 additionally comprises a threaded section 26 which threadedly engages cap member 18. Cap member 18 comprises a short cylinder having an interior cavity 30 receiving pointed second end portion 25. See FIG. 5. Interior cavity 34 comprises a substantially conical depression to accommodate pointed second end portion 25 and a threaded portion 32 engaging threaded section 26 when operationally disposed. Grooves 34 frictionally engage human fingers and may alternately comprise one or more knurled zones.

Figure 6:
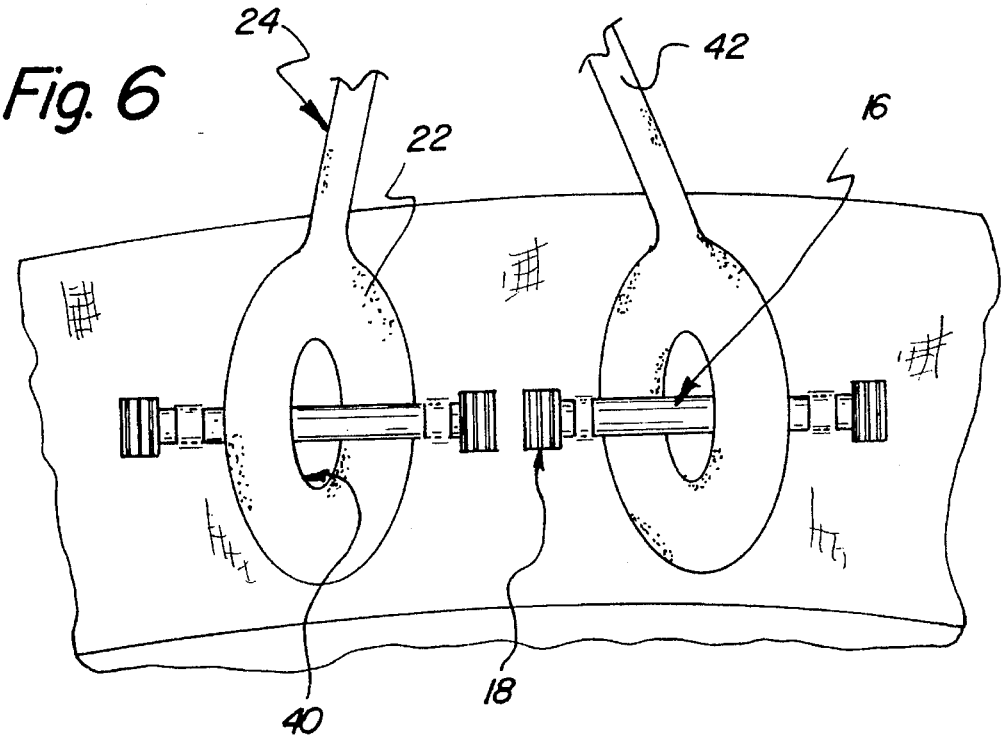
FIG. 6 is a fragmentary perspective view of the removable suspenders holder showing attachment to a clothing article.

Suspender attachment ear 24 comprises two end portions 22 having buttonholes 40 disposed therein and interconnected by a flexible straplike member 42. See FIG. 6. Suspender attachment ear 20 may be of leather composition or other durable materials may be used for construction thereof. Or, a variety of suspender attachment ears 24, some being permanently affixed to complete suspender assemblies, having buttonholes 40 disposed thereon are commercially available and may be employed with removable suspenders holder 10.

Figure 7:
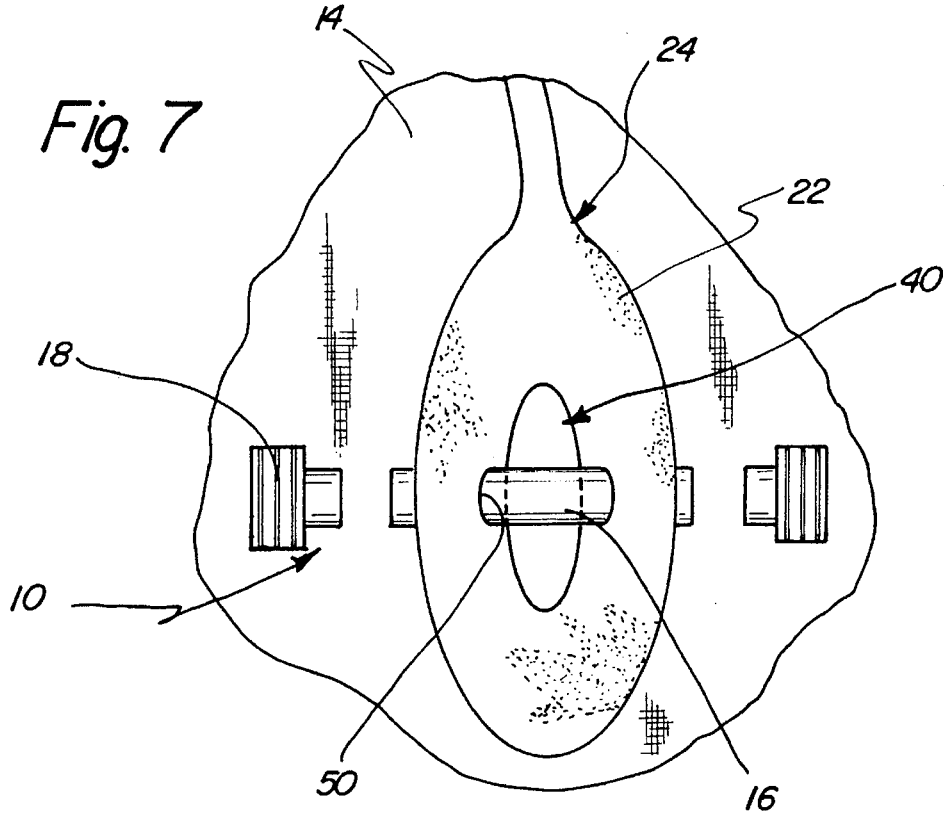
FIG. 7 is a fragmentary perspective view of a removable suspenders holder showing an alternate attachment technique.
Figure 8:
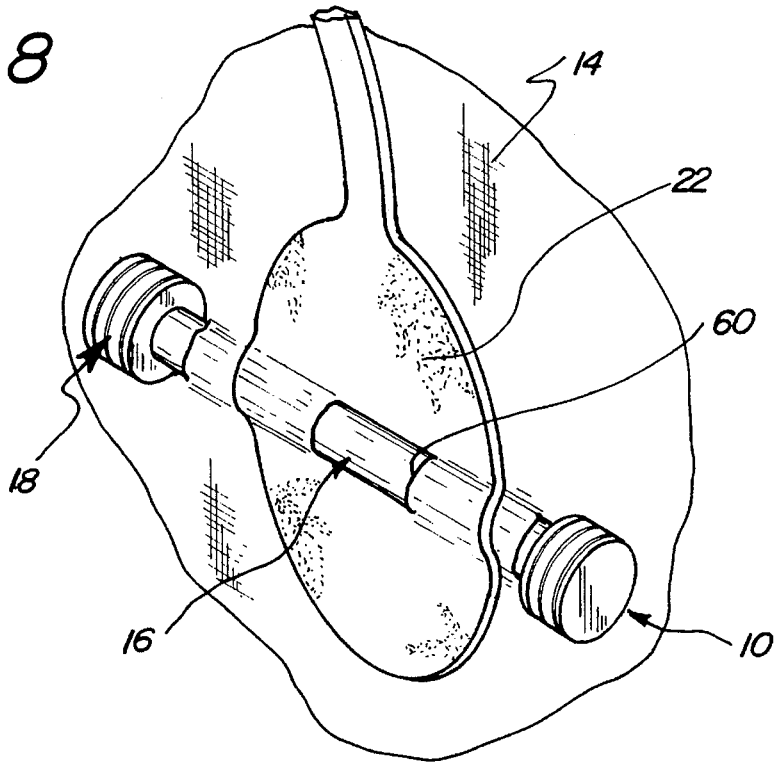
FIG. 8 is a fragmentary perspective view of a removable suspenders holder showing a second alternate attachment technique.

When operationally disposed the suspender attachment ear 24 engaging buttonhole 40 tends to twist and excessively stretch end portion 22. An alternate attachment technique may be employed to mitigate twisting and stretching wherein end portion 22 has two perforations 50 disposed therein. See FIG. 7. Threadedly attaching the pin member 16 through the garment 14 and the perforations 50 enables end portion 22 to lie flatly against garment 14 and furthermore the support provided by two attachment points greatly reduces a propensity for stretching of end portion 22. Yet another attachment variation involves elimination of the buttonhole 40 and having only two perforations 60 disposed therein. See FIG. 8. The absence of buttonhole 40 provides additional strength within end portion 22 while the dual perforations 60 preclude twisting of the end portion 22. And furthermore, the removable suspenders holder 10 may be stored in the end portion 22 when suspenders are detached from the garment 14.

In an alternate embodiment, second pointed end portion 25 and cap member 18 are snappedly attached wherein a circumferential groove is disposed upon second pointed end portion 25 and a spring member within interior cavity 34 engages said groove thereby achieving attachment. Release is achieved by applying tensile force to the joined pin member 16 and cap member 18 whereupon spring force is overcome and the members 16 and 18 are released.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A suspenders holder comprising:

an article of clothing having a waistband;

a suspender attachment ear having a button hole formed therein, the suspender attachment ear being positioned against an interior surface of the waistband of the article of clothing;

a pin member having a first knobbed end portion, an elongated central portion, and a second substantially pointed end portion, the pin member projecting through a portion of the waistband proximal to a first lateral portion of the suspender attachment ear and projecting through the button hole of the first suspender attachment ear, the pin member projecting through a portion of the waistband proximal to a second lateral portion of the suspender attachment ear;

and, a cap member removably coupled to the pin member and covering the second substantially pointed end portion thereof.

2. The suspenders holder of claim 1, wherein the first knobbed end portion of the pin member resides against the interior surface of the waistband, and the cap member resides against the interior surface of the waistband.

3. A suspenders holder comprising:

an article of clothing having a waistband;

a suspender attachment ear having a button hole formed therein, the suspender attachment ear being positioned against an interior surface of the waistband of the article of clothing;

a pin member having a first knobbed end portion, an elongated central portion, and a second substantially pointed end portion, the pin member projecting through a portion of the waistband proximal to a first lateral portion of the suspender attachment ear and projecting through the first lateral portion of the suspender attachment ear, the pin member extending over the button hole of the suspender attachment ear and projecting through a second lateral portion of the suspender attachment ear, the pin member extending through a portion of the waistband proximal to the second lateral portion of the suspender attachment ear;

and, a cap member removably coupled to the pin member and covering the second substantially pointed end portion thereof.

4. The suspenders holder of claim 3, wherein the first knobbed end portion of the pin member resides against the interior surface of the waistband, and the cap member resides against the interior surface of the waistband.

5. A suspenders holder comprising:

an article of clothing having a waistband;

a suspender attachment ear positioned against an interior surface of the waistband of the article of clothing;

a pin member having a first knobbed end portion, an elongated central portion, and a second substantially pointed end portion, the pin member projecting through a portion of the waistband proximal to a first lateral portion of the suspender attachment ear and projecting through the first lateral portion of the suspender attachment ear, the pin member extending over a central portion of the suspender attachment ear and projecting through a second lateral portion of the suspender attachment ear, the pin member extending through a portion of the waistband proximal to the second lateral portion of the suspender attachment ear;

and, a cap member removably coupled to the pin member and covering the second substantially pointed end portion thereof.

6. The suspenders holder of claim 5, wherein the first knobbed end portion of the pin member resides against the interior surface of the waistband, and the cap member resides against the interior surface of the waistband.

* * * * *